United States Patent [19]

Nagashima et al.

[11] 4,382,333

[45] May 10, 1983

[54] CHAIN SAW

[75] Inventors: Akira Nagashima, Kawasaki; Yasuo Saito, Fujisawa, both of Japan

[73] Assignee: Kioritz Corporation, Japan

[21] Appl. No.: 301,171

[22] Filed: Sep. 11, 1981

[30] Foreign Application Priority Data

Mar. 31, 1980 [JP] Japan ..... 55-42428

[51] Int. Cl.[3] ..... F01P 1/02

[52] U.S. Cl. ..... 30/381; 123/41.6

[58] Field of Search ..... 30/381, 382, 383, 384, 30/385, 386; 123/41.6, 41.61, 41.62, 195 C, 198 E

[56] References Cited

U.S. PATENT DOCUMENTS

| | | | |
|---|---|---|---|
| 2,736,299 | 2/1956 | Medenus | 123/41.6 |
| 3,157,211 | 11/1964 | Wiig | 30/386 |
| 3,581,717 | 6/1971 | Fullerton | 123/41.61 X |
| 3,734,070 | 5/1973 | Kobayashi et al. | 123/41.31 |
| 3,747,649 | 7/1973 | Densow et al. | 30/381 |

*Primary Examiner*—Jimmy C. Peters

*Attorney, Agent, or Firm*—Karl W. Flocks

[57] ABSTRACT

A chain saw having a saw chain adapted to be driven by an engine. The engine has a cylinder and a crank case separable from each other. The crank case has cooling air guide walls formed integrally therewith and extending along the upper and lower sides of the cylinder.

1 Claim, 3 Drawing Figures

CHAIN SAW

BACKGROUND OF THE INVENTION

The present invention relates to a chain saw adapted to be driven by a compact engine having a cylinder with a horizontal axis and, more particularly, to a chain saw constructed to facilitate a periodical inspection of cylinder, piston and so forth, as well as renewal of parts.

In the chains saws of the type mentioned above, the engines are usually air-cooled engines having cooling fans. Therefore, during the operation, saw dusts are suspended by the flow of the cooling air flowing around the cylinder of the engine to attach to the latter thereby to lower the cooling efficiency.

It is, therefore, preferred that the chain saw is constructed to permit an easy removal of saw dusts from the area around the cylinder. It is also preferred that the chain saw is constructed to eliminate, in the periodical inspection of major parts such as cylinder and the piston or renewal of the parts, disassembling of parts which are not to be inspected or renewed. Also, the number of parts which are difficult to mount and demount, such as a cylinder cowling, baffle and so forth, is preferably reduced.

It is also necessary that the chain saw is constructed to permit an easy handling and a long stroke of the piston in the cylinder to obtain a greater driving torque from the engine.

Unfortunately, the chain saws proposed and used hitherto could not meet these requirements to a satisfactory extent. Particularly, those who are engaged in the maintenance work for the chain saws have had to face various difficulties in the points mentioned above.

SUMMARY OF THE INVENTION

Accordingly, an object of the invention is to provide a chain saw which can eliminate or overcome the above-described problem of the prior art.

To this end, according to the invention, the engine for driving the chain saw has a crank case formed as a separate body from the cylinder and detachably connected to the latter. In addition, a cooling air guide wall is formed integrally with the crank case to extend therefrom. This arrangement permits an easy disassembling of the cylinder and contributes greatly to the reduction of number of part of the chain saw as a whole.

Namely, according to the invention, there is provided a chain saw with a driving engine, the engine having a cylinder and a crank case detachably secured to each other, the crank case being provided with cooling air guide walls formed integrally therewith and extending along both of upper and lower sides of the cylinder. In consequence, the disassembling of the cylinder is facilitated and the number of the parts is reduced advantageously, thereby to facilitate the periodical inspection and renewal of parts, as well as removal of saw dusts attaching to the outer surface of the cylinder.

The above and other objects, as well as advantageous features of the invention will become more clear from the following description of the preferred embodiments taken in conjunction with the accompanying drawings.

DESCRIPTION OF THE PREFERRED EMBODIMENTS

Figure 1:
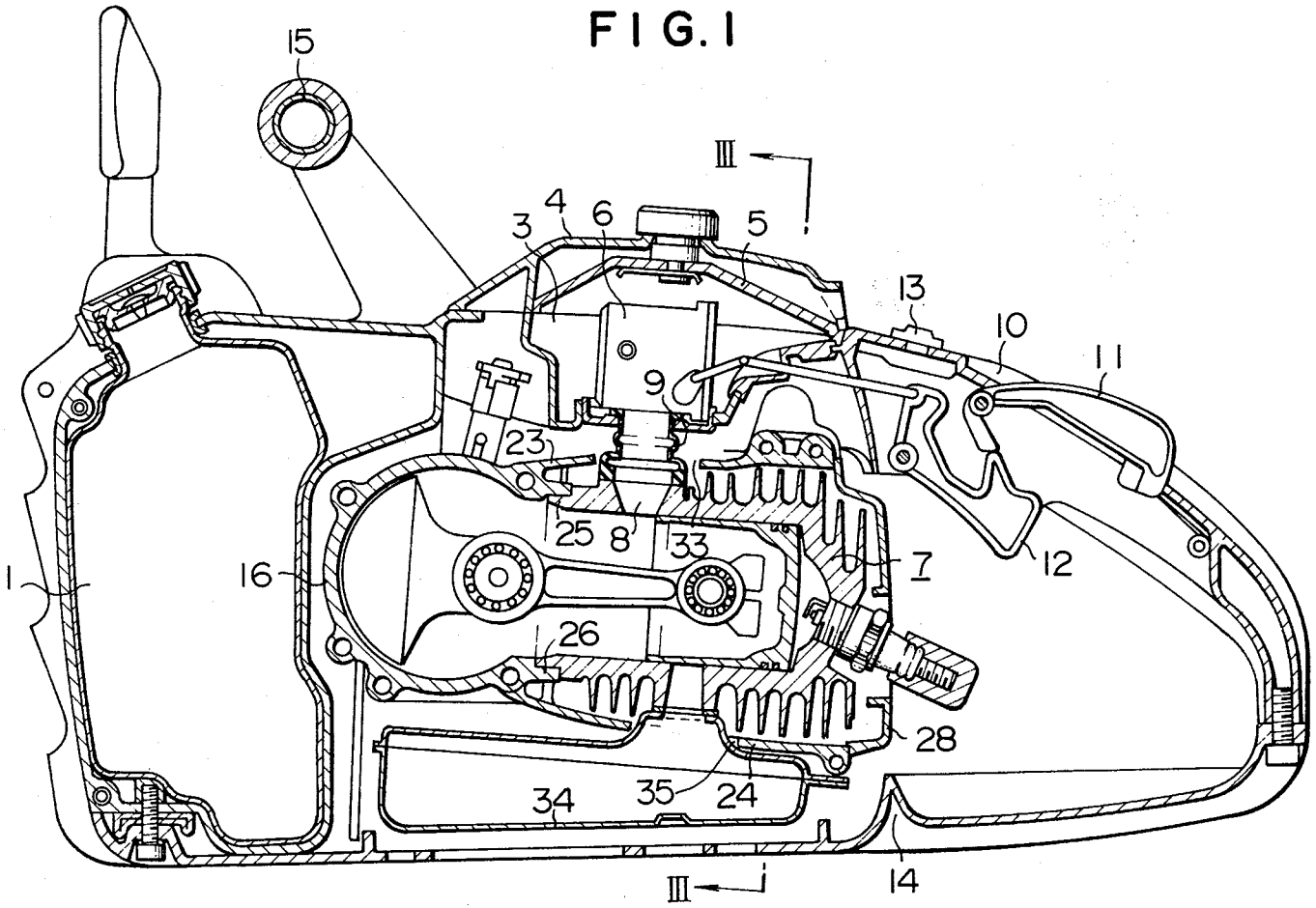
FIG. 1 is a longitudinal sectional view of a chain saw constructed in accordance with an embodiment of the invention.
Figure 2:
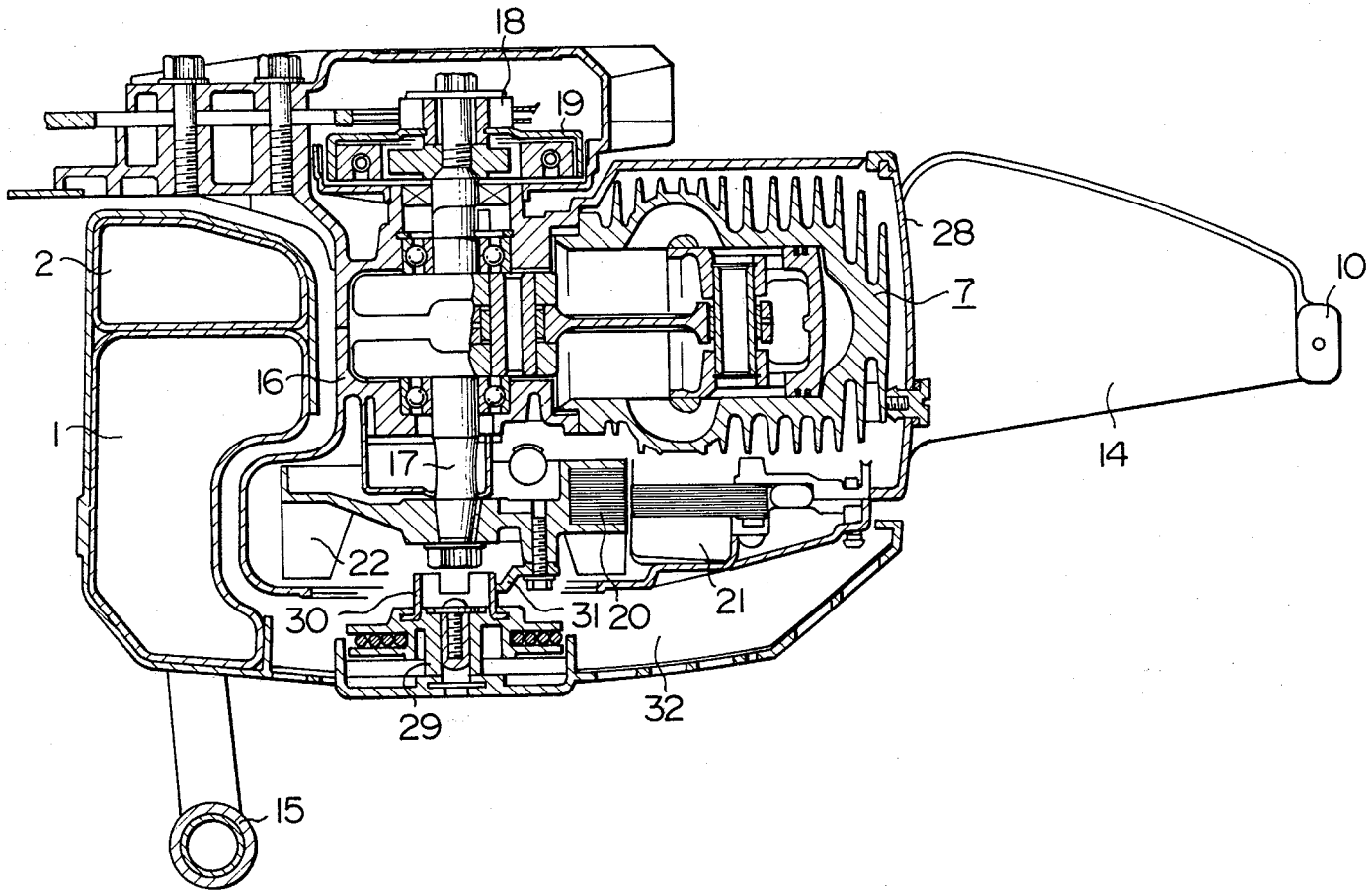
FIG. 2 is a cross-sectional view of the chain saw as shown in FIG. 1.

Referring to the drawings, a portable chain saw constructed in accordance with a preferred embodiment of the invention has a fuel tank 1 and an oil tank 2 arranged in a side-by-side relation at the front portion of the chain saw assembly. A carburetor chamber 3 is provided at the central upper portion of the chain saw assembly. An air cleaner 5 is clamped between a cover 4 and the carburetor chamber 3. The carburetor chamber 3 accomodates a carburetor 6 which has a downward opening facing an intake port 8 of a cylinder and connected to the latter through a flexible pipe 9. Various parts for controlling and manipulating the chain saw, such as a throttle device 11, throttle safety device 12, engine start and stop switch 13 and so forth are mounted on a rear handle 10 extending rearwardly from the rear end of the chain saw assembly. The rear handle 10 is connected and fixed to a bottom plate 14 secured to the bottom of the chain saw assembly. A front handle 15 is extended above the aforementioned tanks 1 and 2.

The chain saw is adapted to be driven by an engine mounted on the central portion of the chain saw assembly in a manner capable of absorbing the vibration. The engine has a cylinder 7 arranged horizontally with the cylinder head directed rearwardly, and a crank case 16 split at its center and formed from castings. A chain driving section disposed at one side of a crank shaft 17 has a chain sprocket 18 connected to the end of the crank shaft 17 through the medium of a centrifugal clutch device 19. At the other side of the crank shaft 17, disposed is a dynamo coil 21 including a primary and a secondary coil and adapted to cooperate with a fly-wheel magneto 20 attached to the end of the crank shaft 17. The fly-wheel has a plurality of fan blades formed on its outer peripheral surface so as to constitute a cooling air fan 22.

Figure 3:
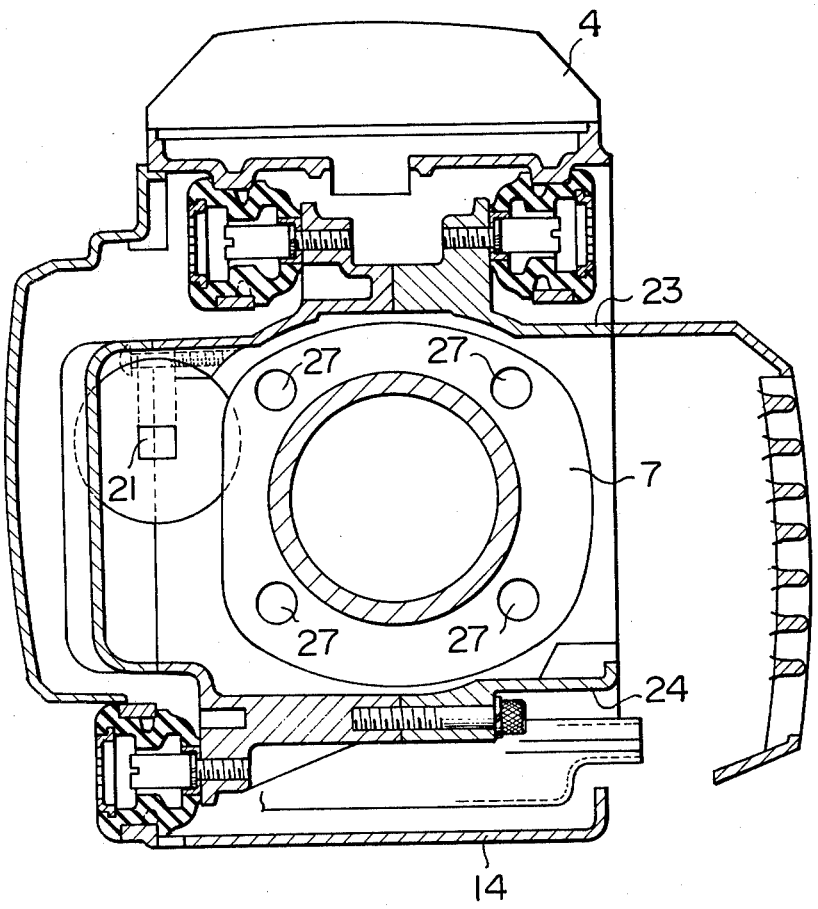
FIG. 3 is a sectional view taken along the line III—III of FIG. 1.

As will be seen from FIG. 1, the crank case 16 has cooling air guide walls 23 and 24 formed integrally therewith and extending along the upper and lower sides of the cylinder 7, as well as an annular seat 26 adapted to receive the brim of the lower opening 25 of the skirt portion of the cylinder 7. The cylinder 7 is firmly secured to the crank case 16 by means of four bolts (not shown) received by four holes 27 of the cylinder 7 as shown in FIG. 3. Thus, the cylinder 7 and the crank case 16 can be separated from each other by loosening these bolts. The engine is secured at its portion near the terminal end of the cooling air guide walls to the frame of the chain saw assembly through a vibration absorption member, and is connected at its front mounting portion to the frame in a manner capable of absorbing the vibration.

The cooling air guide walls 23, 24 are opened at their portions facing the side portions and head portion of the cylinder 7, and are communicated at their one ends with the space around the cooling fan 22, while the other ends are opened to the ambient air. The head end of the these walls is closed by an end cover 28 secured detachably thereto.

A recoin starter 29 coaxial with the crank shaft 17 has a starting claw 30 adapted to cooperate with a driven claw 31 on the fly-wheel in starting the engine.

In the chain saw of the described embodiment, the dynamo coil 21 is disposed in the passage of the cooling air defined around the cylinder 7 by means of the cooling air guide walls 23, 24. In addition, the cooling air guide walls 23, 24 are reinforced by the end cover 28. It will be understood that, by removing the end cover 28 and then loosening four bolts, the cylinder 7 can easily be separated from the crank case 16. In addition, as will be understood from FIG. 1, an opening 33 for permitting the connection between the cylinder 7 and the carburetor 6 is formed in the portion of the cooling air guide wall 23 above the cylinder 7, while an opening 35 for passing an exhaust pipe 34 is formed in the portion of the cooling air guide wall 24 beneath the cylinder 7.

Although the invention has been described through specific terms, it is to be noted that the described embodiment is not exclusive but can be changed and modified without departing from the scope of the attached claim.

What is claimed is:

1. A chain saw having a frame, a saw chain mounted of said frame in such a manner as to run along a predetermined path and an engine mounted on said frame and adapted to drive said saw chain, characterized in that said engine includes a crank case and a cylinder detachably secured to said crank case and arranged horizontally with its head directed rearwardly, and that said crank case has cooling air guide walls formed unitarily therewith and extended along the upper and lower sides of said cylinder, said cooling air guide walls defining a cooling air passage opened at its one side to the atmosphere and communicated at its other end with the air outlet of a cooling fan, the rear side of said cooling air passage facing said head being closed by an end cover secured to the rear ends of said cooling air guide walls, said end cover being detachable from said cooling air guide walls to permit the withdrawal of said cylinder after detaching of said cylinder from said crank case.

* * * * *